US009744580B2

(12) United States Patent
Nakamura et al.

(10) Patent No.: US 9,744,580 B2
(45) Date of Patent: Aug. 29, 2017

(54) IRONING MOLD AND FORMED MATERIAL MANUFACTURING METHOD

(71) Applicant: Nisshin Steel Co., Ltd., Tokyo (JP)

(72) Inventors: Naofumi Nakamura, Sakai (JP); Yudai Yamamoto, Sakai (JP); Jun Kurobe, Sakai (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 15/113,867

(22) PCT Filed: Apr. 15, 2014

(86) PCT No.: PCT/JP2014/060704

§ 371 (c)(1),
(2) Date: Jul. 25, 2016

(87) PCT Pub. No.: WO2015/111233

PCT Pub. Date: Jul. 30, 2015

(65) Prior Publication Data

US 2016/0339498 A1 Nov. 24, 2016

(30) Foreign Application Priority Data

Jan. 27, 2014 (JP) ..... 2014-012290

(51) Int. Cl.
*B21D 22/30* (2006.01)

(52) U.S. Cl.
CPC ..... *B21D 22/30* (2013.01)

(58) Field of Classification Search
CPC ..... B21D 22/00; B21D 22/02; B21D 22/20; B21D 22/21; B21D 22/30
See application file for complete search history.

(56) References Cited

FOREIGN PATENT DOCUMENTS

| | | | |
|---|---|---|---|
| JP | 10-156481 | A | 6/1998 |
| JP | 2002-267014 | A | 9/2002 |
| JP | 5395301 | B1 | 1/2014 |
| WO | 2013008892 | A1 | 1/2013 |

*Primary Examiner* — Teresa M Ekiert
(74) *Attorney, Agent, or Firm* — Rothwell, Figg, Ernst & Manbeck, P.C.

(57) ABSTRACT

An ironing mold according to the present invention is provided with a punch, and a die which forms a pushing hole with respect to the punch. When the skewness Rsk of a surface treated metal plate is less than −0.6 and no less than −1.3, then the curvature radius of a shoulder portion of the die and a clearance between a radius end and the punch are determined such that Y, which is expressed by $\{(t_{re}-c_{re})/t_{re}\}\times 100$, and X, which is expressed by $r/t_{re}$, satisfy $0<Y\leq 18.7X-6.1$, X satisfies $X\geq 0.6$ and r satisfies $r\leq 0.5$ h.

6 Claims, 5 Drawing Sheets

IRONING MOLD AND FORMED MATERIAL MANUFACTURING METHOD

CROSS REFERENCE TO RELATED APPLICATION

This application is a 35 U.S.C. 371 National Phase Entry Application from PCT/JP2014/060704, filed Apr. 15, 2014, which claims the benefit of Japanese Patent Application No. 2014-012290 filed on Jan. 27, 2014, the disclosures of which are incorporated herein in its entirety by reference.

TECHNICAL FIELD

The present invention relates to an ironing mold used to perform ironing on a folded and drawn formed portion, and a formed material manufacturing method.

BACKGROUND ART

A ring-shaped folded and drawn formed portion is typically formed by press forming such as drawing using a surface treated metal plate such as a coated steel plate as a raw material. For example, in PTL 1, a ring-shaped oil groove 17 is formed by a folding and drawing process in a portion of a housing 1 of an electric motor. The folded and drawn formed portion is a portion which is formed by folding a single sheet member, and includes an inner peripheral wall, an outer peripheral wall, and a fold portion which links the front ends of the inner peripheral wall and the outer peripheral wall. When the folded and drawn formed portion requires particularly high dimensional precision, ironing is implemented on the folded and drawn formed portion after the folded and drawn formed portion has been formed. Ironing is a process in which a clearance between a punch and a die is set to be narrower than a thickness of the folded and drawn formed portion prior to ironing, and the folded and drawn formed portion is then ironed using the punch and the die so that the thickness of the folded and drawn formed portion matches the clearance between the punch and the die. Ironing for a folded and drawn formed portion of this kind is also known as a "restrike".

The folded and drawn formed portion is formed by a mold which is generally configured in the following manner. In other words, a conventional mold is provided with a punch, a die, and a counter pad part. The punch is configured as a columnar member, and the die is configured as a ring-shaped member which is disposed on the outer periphery of the punch. A pushing hole into which the folded and drawn formed portion is pushed is formed between the punch and the die. The die has a shoulder portion disposed on an outer edge of an inlet of the pushing hole and constituted by a curved surface having a predetermined curvature radius, and an inner peripheral surface which extends linearly parallel to the pushing direction from a radius end of the shoulder portion. The outer peripheral surface of the punch and the inner peripheral surface of the pushing hole extend mutually in parallel along the pushing direction of the folded and drawn formed portion.

The counter pad part is a member which is arranged facing the punch and the die in such a manner that the folded and drawn formed portion is positioned between the punch and the die, and the counter pad part pushes the folded and drawn formed portion into the pushing hole by relative displacement of the counter pad part with respect to the punch and the die. The wall surface of the outer peripheral wall of the folded and drawn formed portion is ironed by the shoulder portion when pushed into the pushing hole, and the whole folded and drawn formed portion is gradually thinned until coinciding with the width of the clearance between the outer peripheral surface of the punch and the inner peripheral surface of the pushing hole.

CITATION LIST

Patent Literature

[PTL 1]
Japanese Patent Application Publication No. 2012-167818

SUMMARY OF INVENTION

Technical Problem

In general, when the folded and drawn formed portion is pushed into the pushing hole, the folded and drawn formed portion is ironed and thinned by the shoulder portion of the die, from the fold portion on the front end side towards the counter pad side. In this case, since the thinned material is pushed towards the counter pad side, then the material plate thickness is greater towards the counter pad side, and the thick portion of the folded and drawn formed portion is subjected to a greater amount of ironing. Therefore, a surface treated layer of the portion of increased thickness is shaved, and therefore a powdery residue may be generated. The powdery residue causes problems such as formation of minute pockmarks (dents) in the surface of the formed portion after ironing, and deterioration of the performance of a product made using the formed material. Furthermore, when the radius of the shoulder portion of the die is small, then at the bottom dead center of the pressing action, the material which has been pushed by the ironing is crushed between the counter pad and the punch and the die, and generates a large residual compressive stress. This residual compressive stress is a cause of dimensional variation due to elastic deformation, in the product when released from the mold after forming.

The present invention was devised in order to resolve the problems described above, an object thereof being to provide an ironing mold and a formed material manufacturing method whereby the generation of a large load on a part of a surface treated layer can be avoided, an amount of generated powdery residue can be reduced, and deterioration in the dimensional precision of the folded and drawn formed portion after ironing can be prevented.

Solution to Problem

The ironing mold according to the present invention is an ironing mold for performing ironing on a folded and drawn formed portion which is formed using a surface treated metal plate as a raw material and which has an inner peripheral wall, an outer peripheral wall and a fold portion linking front ends of the inner peripheral wall and the outer peripheral wall, including: a punch; a die which is disposed on the outer periphery of the punch and which forms, with respect to the punch, a pushing hole into which the folded and drawn formed portion is pushed with the fold portion to the front; and a counter pad part which is disposed facing the punch and the die in such a manner that the folded and drawn formed portion is positioned between the punch and the die, and which pushes the folded and drawn formed portion into the pushing hole by relative displacement of the counter pad part with respect to the punch and the die, wherein the die includes a shoulder portion disposed on an outer edge of an inlet of the pushing hole and constituted by a curved surface having a predetermined curvature radius, and an inner peripheral surface which extends from a radius end of the shoulder portion in a pushing direction of the folded and drawn formed portion, and along which a surface of the outer peripheral wall of the folded and drawn formed portion slides in response to the pushing of the folded and drawn formed portion; a skewness Rsk of the surface treated metal plate is less than −0.6 and no less than −1.3; the curvature radius of the shoulder portion and the clearance between the radius end and the punch are determined such that, when the curvature radius of the shoulder portion is represented by r, the clearance between the radius end and the punch is represented by $c_{re}$, a thickness of the folded and drawn formed portion prior to the ironing at a position that is sandwiched between the radius end and the punch upon completion of the ironing is represented by $t_{re}$ and a height of the folded and drawn formed portion is represented by h, then Y, which is expressed by $\{(t_{re}-c_{re})/t_{re}\}\times 100$, and X, which is expressed by $r/t_{re}$, satisfy $0<Y\leq 18.7X-6.1$, X satisfies $X\geq 0.6$, and r satisfies $r\leq 0.5$ h.

Furthermore, the ironing mold according to the present invention is an ironing mold for performing ironing on a folded and drawn formed portion which is formed using a surface treated metal plate as a raw material and which has an inner peripheral wall, an outer peripheral wall and a fold portion linking front ends of the inner peripheral wall and the outer peripheral wall, including: a punch; a die which is disposed on the outer periphery of the punch and which forms, with respect to the punch, a pushing hole into which the folded and drawn formed portion is pushed with the fold portion to the front; and a counter pad part which is disposed facing the punch and the die in such a manner that the folded and drawn formed portion is positioned between the punch and the die, and which pushes the folded and drawn formed portion into the pushing hole by relative displacement of the counter pad part with respect to the punch and the die, wherein the die includes a shoulder portion disposed on an outer edge of an inlet of the pushing hole and constituted by a curved surface having a predetermined curvature radius, and an inner peripheral surface which extends from a radius end of the shoulder portion in a pushing direction of the folded and drawn formed portion, and along which a surface of the outer peripheral wall of the folded and drawn formed portion slides in response to the pushing of the folded and drawn formed portion; a skewness Rsk of the surface treated metal plate is no less than −0.6 and no more than 0; the curvature radius of the shoulder portion and the clearance between the radius end and the punch are determined such that, when the curvature radius of the shoulder portion is represented by r, the clearance between the radius end and the punch is represented by $c_{re}$, a thickness of the folded and drawn formed portion prior to the ironing at a position that is sandwiched between the radius end and the punch upon completion of the ironing is represented by $t_{re}$ and a height of the folded and drawn formed portion is represented by h, then Y, which is expressed by $\{(t_{re}-c_{re})/t_{re}\}\times 100$, and X, which is expressed by $r/t_{re}$, satisfy $0<Y\leq 14.4X-6.4$, X satisfies $X\geq 0.8$, and r satisfies $r\leq 0.5$ h.

The formed material manufacturing method according to the present invention is a formed material manufacturing method including the steps of: forming a ring-shaped folded and drawn formed portion having an inner peripheral wall, an outer peripheral wall and a fold portion linking front ends of the inner peripheral wall and the outer peripheral wall, by performing at least one forming process on a surface treated metal plate; and performing ironing on the folded and drawn formed portion using an ironing mold after forming the folded and drawn formed portion, wherein the ironing mold includes: a punch; a die which is disposed on the outer periphery of the punch and which forms, with respect to the punch, a pushing hole into which the folded and drawn formed portion is pushed with the fold portion to the front; and a counter pad part which is disposed facing the punch and the die in such a manner that the folded and drawn formed portion is positioned between the punch and the die, and which pushes the folded and drawn formed portion into the pushing hole by relative displacement of the counter pad part with respect to the punch and the die, the die includes a shoulder portion disposed on an outer edge of an inlet of the pushing hole and constituted by a curved surface having a predetermined curvature radius, and an inner peripheral surface which extends from a radius end of the shoulder portion in a pushing direction of the folded and drawn formed portion, and along which a surface of the outer peripheral wall of the folded and drawn formed portion slides in response to the pushing of the folded and drawn formed portion; a skewness Rsk of the surface treated metal plate is less than −0.6 and no less than −1.3; and the curvature radius of the shoulder portion and the clearance between the radius end and the punch are determined such that, when the curvature radius of the shoulder portion is represented by r, the clearance between the radius end and the punch is represented by $c_{re}$, a thickness of the folded and drawn formed portion prior to the ironing at a position that is sandwiched between the radius end and the punch upon completion of the ironing is represented by $t_{re}$ and a height of the folded and drawn formed portion is represented by h, then Y, which is expressed by $\{(t_{re}-c_{re})/t_{re}\}\times 100$, and X, which is expressed by $r/t_{re}$, satisfy $0<Y\leq 18.7X-6.1$, X satisfies $X\geq 0.6$, and r satisfies $r\leq 0.5$ h.

Furthermore, the formed material manufacturing method according to the present invention is a formed material manufacturing method including the steps of: forming a ring-shaped folded and drawn formed portion having an inner peripheral wall, an outer peripheral wall and a fold portion linking front ends of the inner peripheral wall and the outer peripheral wall, by performing at least one forming process on a surface treated metal plate; and performing ironing on the folded and drawn formed portion using an ironing mold after forming the folded and drawn formed portion, wherein the ironing mold includes: a punch; a die which is disposed on the outer periphery of the punch and which forms, with respect to the punch, a pushing hole into which the folded and drawn formed portion is pushed with the fold portion to the front; a counter pad part which is disposed facing the punch and the die in such a manner that the folded and drawn formed portion is positioned between the punch and the die, and which pushes the folded and drawn formed portion into the pushing hole by relative displacement of the counter pad part with respect to the punch and the die, the die includes a shoulder portion disposed on an outer edge of an inlet of the pushing hole and constituted by a curved surface having a predetermined curvature radius, and an inner peripheral surface which extends from a radius end of the shoulder portion in a pushing direction of the folded and drawn formed portion, and along which a surface of the outer peripheral wall of the folded and drawn formed portion slides in response to the pushing of the folded and drawn formed portion; a skewness Rsk of the surface treated metal plate is no less than −0.6 and no more than 0; and the curvature radius of the shoulder portion and the clearance between the radius end and the punch are determined such that, when the curvature radius of the shoulder portion is represented by r, the clearance between the radius end and the punch is represented by $c_{re}$, a thickness of the folded and drawn formed portion prior to the ironing at a position that is sandwiched between the radius end and the punch upon completion of the ironing is represented by $t_{re}$ and a height of the folded and drawn formed portion is represented by h, then Y, which is expressed by $\{(t_{re}-c_{re})/t_{re}\}\times 100$, and X, which is expressed by $r/t_{re}$, satisfy $0<Y\leq 14.4X-6.4$, X satisfies $X\geq 0.8$, and r satisfies $r\leq 0.5$ h.

Advantageous Effects of Invention

According to the ironing mold and the formed material manufacturing method of the present invention, since the pushing hole is configured in such a manner that the material pushed by the ironing of the folded and drawn formed portion is not crushed excessively between the punch and the die and the counter pad, at the bottom dead center of the pressing action, then the generation of a large load on a part of the surface treated layer can be avoided, and deformation after separation from the mold can also be reduced. Consequently, the amount of generated powdery residue can be reduced, and deterioration in the dimensional precision of the folded and drawn formed portion after ironing can be prevented.

DESCRIPTION OF EMBODIMENTS

Below, an embodiment of this invention is described with reference to the drawings.

First Embodiment

Figure 1:
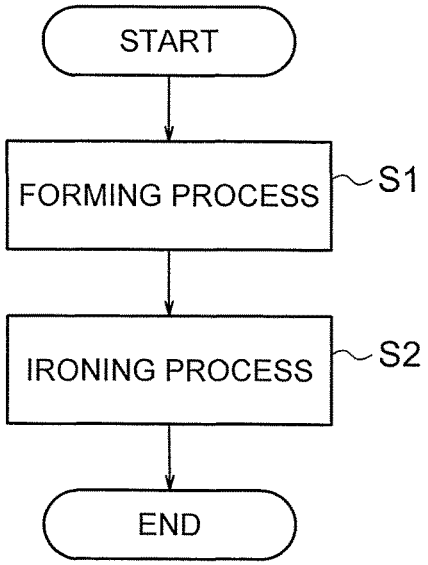
FIG. 1 is a flowchart showing a formed material manufacturing method according to an embodiment of the present invention.
Figure 2:
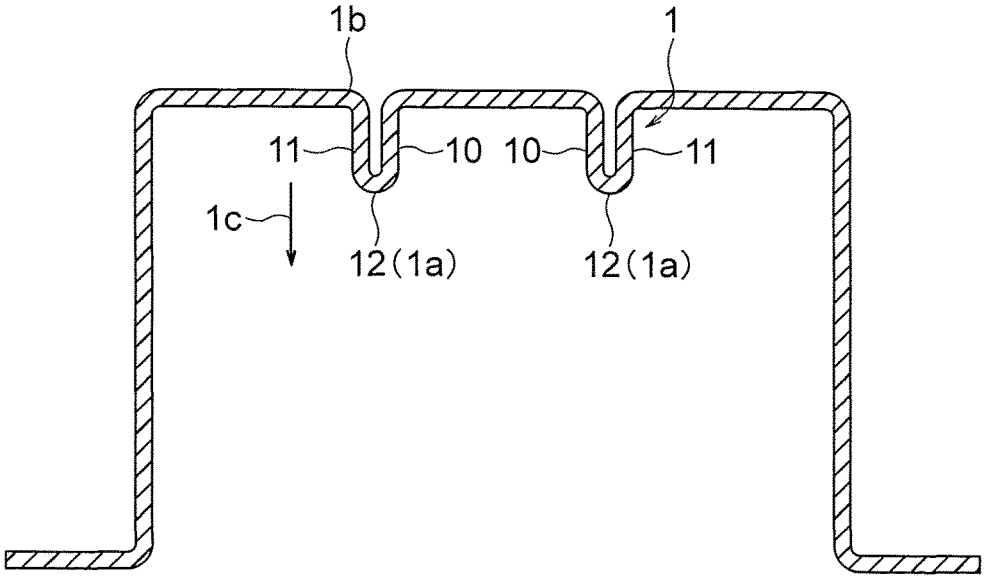
FIG. 2 is a cross-sectional diagram of a formed material including a folded and drawn formed portion which is formed in the forming step S1 in FIG. 1.
Figure 3:
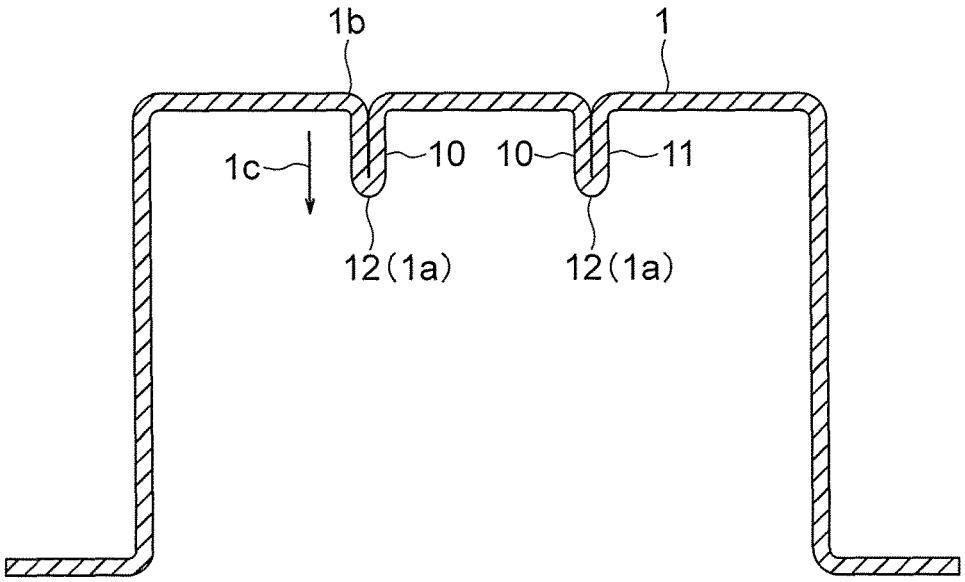
FIG. 3 is a cross-sectional diagram of a formed material including a folded and drawn formed portion after carrying out an ironing process S2 in FIG. 1.

FIG. 1 is a flowchart showing a formed material manufacturing method according to an embodiment of the present invention, FIG. 2 is a cross-sectional diagram of a formed material including a folded and drawn formed portion 1 which is formed by the forming process S1 in FIG. 1, and FIG. 3 is a cross-sectional diagram of a formed material including a folded and drawn formed portion 1 after carrying out the ironing process S2 in FIG. 1.

As shown in FIG. 1, the formed material manufacturing method according to the present embodiment includes a forming process S1 and the ironing process S2. The forming process S1 is a step for forming a ring-shaped folded and drawn formed portion 1 (see FIG. 2) by performing at least one forming process on a surface-treated metal plate. The forming process includes a pressing process, such as a drawing process or stretching. The surface treated metal plate is a metal plate having a surface treated layer on a surface thereof. The surface treated layer includes a painted film or a coating layer. In the present embodiment, the surface treated metal plate is described as a Zn (zinc) coated steel plate formed by applying a Zn coating to a surface of a steel plate.

As shown in FIG. 2, the folded and drawn formed portion 1 according to this embodiment is a ring-shaped wall formed by forming the Zn coated steel plate into a cap body, and then forming the plate so as to project towards the inside of the cap body from the apex portion of the cap body, and the folded and drawn formed portion 1 includes an inner peripheral wall 10 and an outer peripheral wall 11, and a fold portion 12 which links the front ends of the inner peripheral wall 10 and the outer peripheral wall 11. Hereafter, a direction extending from a base portion 1*b* (the rear end side of the inner peripheral wall 10 and the outer peripheral wall 11) to an apex portion 1*a* (fold portion 12) of the folded and drawn formed portion 1 is called the pushing direction 1*c*. The pushing direction 1*c* means a direction in which the folded and drawn formed portion 1 is pushed into a pushing hole (see FIG. 5) that is provided in a die of the ironing mold which is described below.

The ironing process S2 is a process for performing ironing on the folded and drawn formed portion 1 by using the ironing mold described below. Ironing is a process in which a clearance between a punch and a die of an ironing mold is set to be narrower than a thickness of the folded and drawn formed portion 1 prior to ironing, and the folded and drawn formed portion 1 is then ironed using the punch and the die so that the thickness of the folded and drawn formed portion 1 matches the clearance between the punch and the die. In other words, the thickness of the folded and drawn formed portion 1 after ironing is less than the thickness of the folded and drawn formed portion 1 prior to ironing. Ironing for a folded and drawn formed portion 1 of this kind is also known as a "restrike".

As indicated in FIG. 3, by carrying out the ironing, the position of the inner peripheral wall 10 hardly changes, and the outer peripheral wall 11 approaches the inner peripheral wall 10 so as to fill in the gap between the inner peripheral wall 10 and the outer peripheral wall 11. The formed material manufactured by performing the forming process S1 and the ironing process S2, in other words, the formed material manufactured by the formed material manufacturing method of the present embodiment, can be used in various applications, but is used in particular in applications which require dimensional precision in the folded and drawn formed portion 1, such as the bearings of a container which houses an electric motor, or the like.

Figure 4:
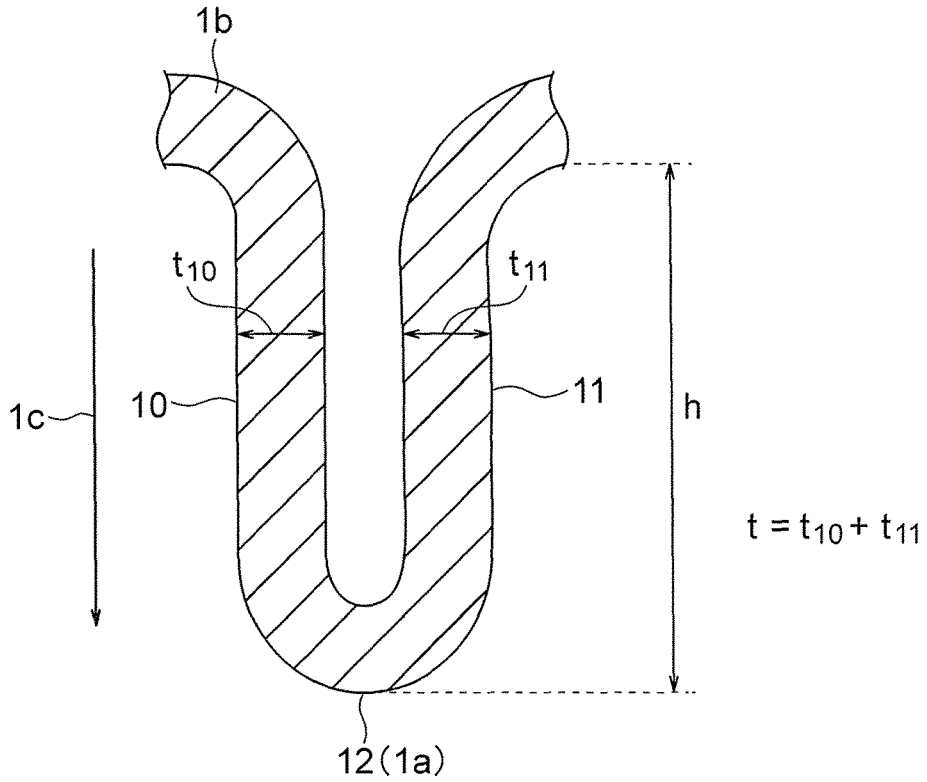
FIG. 4 is a cross-sectional diagram showing an enlarged view of one portion of the folded and drawn formed portion in FIG. 2.

Next, FIG. 4 is a cross-sectional diagram showing an enlarged view of one portion of the folded and drawn formed portion 1 in FIG. 2. The thickness t of the folded and drawn formed portion 1 is the sum of the plate thickness $t_{10}$ of the inner peripheral wall 10 and the plate thickness $t_{11}$ of the outer peripheral wall 11. Moreover, a feature of the folded and drawn formed portion is that there is a gap between the inner peripheral wall 10 and the outer peripheral wall 11. Normally, it is desirable for the shoulder portion of the die to contact the portion of the outer peripheral wall 11 nearer to the die, in other words, the portion of the outer peripheral wall 11 nearer to the straight portion. However, as described above, by providing a gap between the inner peripheral wall 10 and the outer peripheral wall 11, the shoulder portion of the die contacts the portion of the outer peripheral wall 11 nearer to the punch.

Normally, the front end-side curved surface portion of the outer peripheral wall 11 and the curved surface portion of the die shoulder make contact so as to form an acute angle mutually with respect to the direction of travel. Due to the presence of the gap, however, the shoulder portion of the die contacts the portion of the outer peripheral wall 11 nearer to the punch, and the front end-side curved surface portion of the outer peripheral wall 11 and the curved surface portion of the die shoulder make contact at an obtuse angle.

Consequently, since the deformation resistance which causes the outer peripheral wall 11 to make tight contact with the inner peripheral wall 10 increases, then a large load is generated on a part of the surface treated layer, leading to the generation of powdery residue.

Furthermore, as the radius of the shoulder portion of the die decreases, the portion on the outer peripheral wall 11 that is contacted by the die shoulder portion becomes nearer to the punch, and therefore the die shoulder portion and the outer peripheral wall 11 make contact at an obtuse angle, thus leading to increase in the deformation resistance giving rise to powdery residue.

Figure 5:
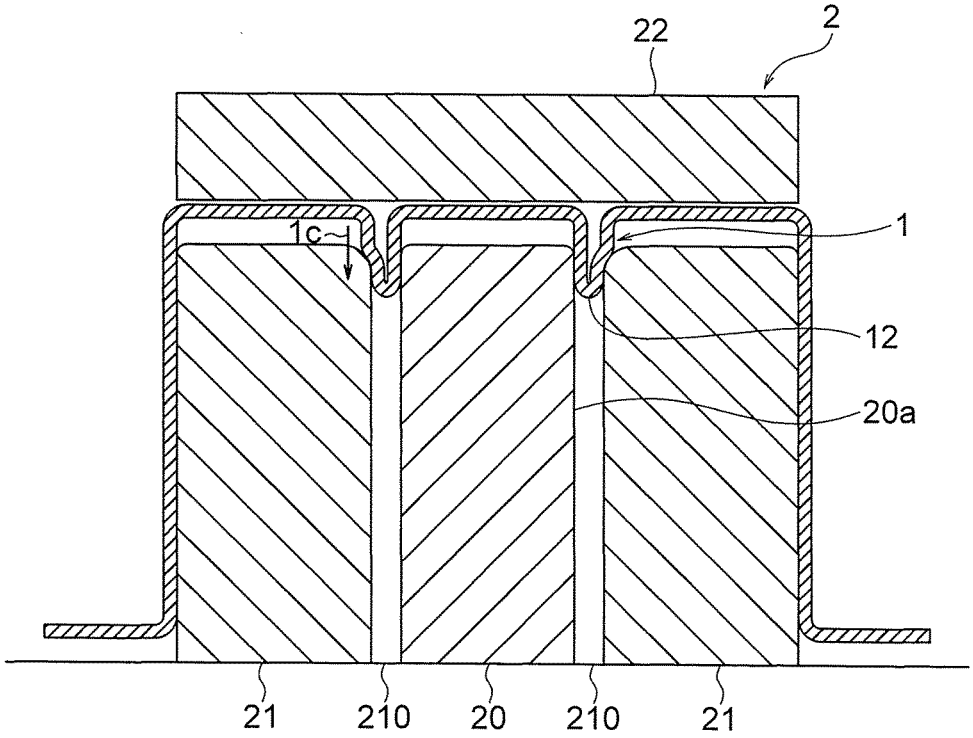
FIG. 5 is a cross-sectional diagram of an ironing mold used in the ironing process S2 in FIG. 1.
Figure 6:
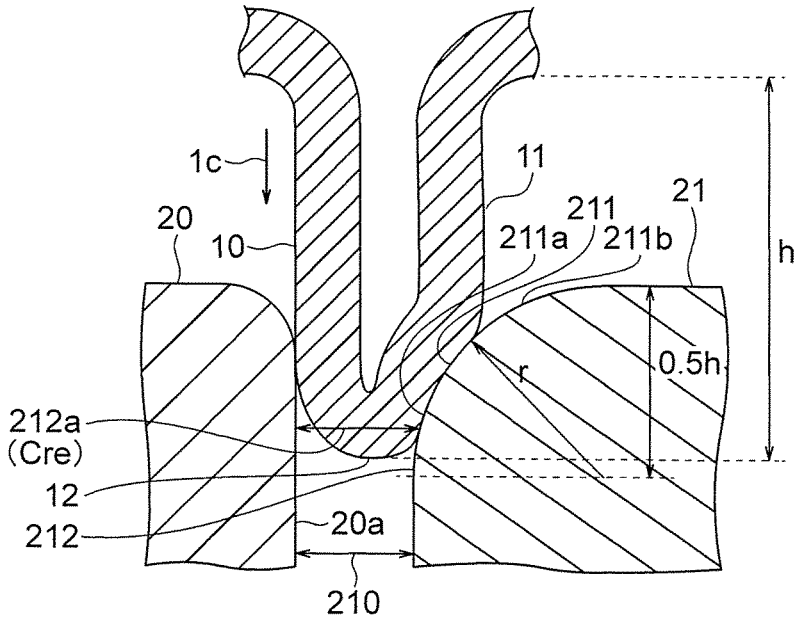
FIG. 6 is an illustrative diagram showing an enlarged view of the periphery of a shoulder portion in a state where ironing is being performed on a formed portion using the ironing mold in FIG. 5.

Next, FIG. 5 is a cross-sectional diagram of an ironing mold 2 which is used in the ironing process S2 in FIG. 1, and FIG. 6 is an illustrative diagram showing an enlarged view of the periphery of a shoulder portion 211 in a state where ironing is performed on the formed portion using the ironing mold 2 in FIG. 5. In FIG. 5, the ironing mold 2 is provided with a punch 20, a die 21 and a cushion pad part 22. The punch 20 is a convex body that is inserted inside the folded and drawn formed portion 1 described above. An outer diameter of the punch 20 is substantially equal to the inner diameter of the folded and drawn formed portion 1 prior to the ironing. The outer peripheral surface 20*a* of the punch 20 extends linearly in parallel with the pushing direction 1*c*. The die 21 is a ring-shaped body which is arranged on the outer periphery of the punch 20. The inner diameter of the die 21 is greater than the outer diameter of the punch 20, and is smaller than the outer diameter of the folded and drawn formed portion 1 prior to ironing. In this way, by making the outer diameter of the punch 20 substantially equal to the inner diameter of the folded and drawn formed portion 1, and making the inner diameter of the die 21 smaller than the outer diameter of the folded and drawn formed portion 1, then the position of the inner peripheral wall 10 hardly changes as a result of the ironing, and the outer peripheral wall 11 approaches the inner peripheral wall 10 so as to fill in the gap between the inner peripheral wall 10 and the outer peripheral wall 11. Furthermore, there is no significant change in the material thickness of the inner peripheral wall 10 and it is principally the outer peripheral wall 11 that is thinned.

A pushing hole 210 into which the folded and drawn formed portion 1 is pushed is formed between the die 21 and the punch 20. As shown in FIG. 6, the die 21 includes a shoulder portion 211 and an inner peripheral surface 212. The shoulder portion 211 is disposed on an outer edge of an inlet of the pushing hole 210, and is constituted by a curved surface having a predetermined curvature radius. The inner peripheral surface 212 is a wall surface extending in the pushing direction 1*c* from a radius end 211*a* of the shoulder portion 211. The radius end 211*a* of the shoulder portion 211 means a terminal end of the curved surface constituting the shoulder portion 211 on an inner side of the pushing hole 210. The fact that the inner peripheral surface 212 extends in the pushing direction 1*c* means that a component of the pushing direction 1*c* is included in an extension direction of the inner peripheral surface 212.

The cushion pad part 22 is made from carbon tool steel, or alloy tool steel, for example, and is arranged to face the punch 20 and die 21. The cushion pad part 22 is provided so as to be displaceable relatively with respect to the punch 20 and die 21. In the present embodiment, the cushion pad part 22 is provided so as to be displaceable in a direction towards the punch 20 and die 21, and a direction away from the punch 20 and die 21. The folded and drawn formed portion 1 is disposed between the cushion pad part 22 and the punch 20 and die 21. The folded and drawn formed portion 1 is pushed into the pushing hole 210, by displacement of the cushion pad part 22 in a direction towards the punch 20 and die 21.

When the folded and drawn formed portion 1 is pushed into the pushing hole 210, the wall surface of the outer peripheral wall 11 of the folded and drawn formed portion 1 is ironed by the shoulder portion 211, as shown in FIG. 6.

In order to prevent the occurrence of powdery coating residue when the outer wall 11 of the folded and drawn formed portion 1 contacts the shoulder portion 211 of the die 21, the radius r of the shoulder portion 211 of the die 21 must be set to a large value so as to contact the outer wall 11 of the folded and drawn formed portion 1 at an acute angle.

Furthermore, the surface of the outer peripheral wall 11 of the folded and drawn formed portion 1 slides along the inner peripheral surface 212 due to being pushed into the pushing hole 210. The outer wall 11 of the folded and drawn formed portion 1 is thinned as the ironing advances, and surplus material is pushed towards the counter pad side. In this case, the material which has been thinned is pushed towards the counter pad side, and therefore the material plate thickness becomes larger towards the counter pad side. Consequently, nearer to the counter pad side, the amount of ironing becomes greater and the surface treated layer is shaved more readily. Therefore, by increasing the radius r of the shoulder portion 211 of the die 21, the gap between the punch 20 and the die 21 at the position corresponding to r is increased, and increase in the amount of ironing is suppressed.

Moreover, the material that is thinned and pushed by the ironing is then crushed between the die 21 and punch 20, and the counter pad 22, at the bottom dead center of the pressing action. In this case, the volume of the pushed material increases as the clearance becomes smaller, and therefore, as the clearance becomes smaller, the extent of crushing at the bottom dead center of the press increases, leading to dimensional variations after separation from the mold due to increase in the residual compressive stress. In this respect also, by increasing the radius r of the shoulder portion 211, it is possible to ensure a large space between the punch 20 and the counter pad 22 at the bottom dead center of the press, and therefore it is possible to prevent dimensional variations after separation from the mold.

As described above, the smaller the clearance between the punch 20 and the die 21, the greater the increase in the volume of the pushed material, and therefore in order to prevent the generation of coating residue and to improve dimensional precision, it is necessary to increase the radius r of the shoulder portion 211. However, when the radius r of the shoulder portion 211 is too large, then the gap between the punch 20 and the die 21 becomes too large, which leads conversely to deterioration in the dimensional precision. In other words, if the radius r of the shoulder portion 211 is too large, then the inner peripheral wall 10 and the outer peripheral wall 11 deform greatly along the curved surface of the shoulder portion 211. The magnitude of the deformation of the inner peripheral wall 10 and the outer peripheral wall 11 along the curved surface of the shoulder portion 211 has a correlation with the length of the inner peripheral wall 10 and the outer peripheral wall 11 which is processed by the shoulder portion 211, in other words, the height h of the folded and drawn formed portion 1 (see FIG. 4).

Figure 7:
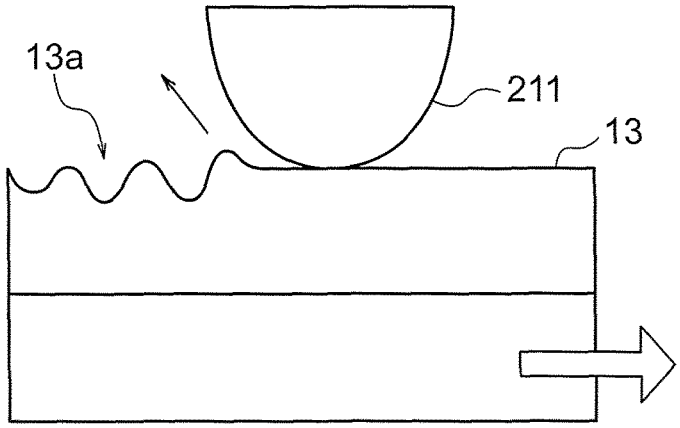
FIG. 7 is a schematic illustrative view showing a relationship between the shoulder portion and a coating layer of a Zn coated steel plate in FIG. 6.

Next, a mechanism by which coating residue is generated due to the ironing by the shoulder portion 211 will be described with reference to FIG. 7. FIG. 7 is a schematic illustrative view showing a relationship between the shoulder portion 211 and a coating layer 13 of the Zn coated steel plate in FIG. 6. As shown in FIG. 7, minute irregularities 13*a* exist on the surface of the coating layer 13 on the Zn coated steel plate. When the plate surface of the formed portion 1 is ironed by the shoulder portion 211, as shown in FIG. 6, the irregularities 13*a* may be shaved by the shoulder portion 211 and give rise to coating residue.

The amount of generated coating residue has a correlation with a ratio r/t between the curvature radius r of the shoulder portion 211 and the thickness t of the folded and drawn formed portion 1. As the curvature radius r of the shoulder portion 211 decreases, local skewness increases, leading to an increase in sliding resistance between the surface of the coating layer 13 and the shoulder portion 211, and therefore the amount of generated coating residue increases. Furthermore, as the thickness t of the folded and drawn formed portion 1 increases, an amount of thinning by the shoulder portion 211 increases, leading to an increase in a load applied to the surface of the Zn coated steel plate, and consequently the amount of generated coating residue increases. In other words, the amount of generated coating residue increases, the smaller the ratio r/t, and the amount of generated coating residue decreases, the greater the ratio r/t.

In particular, the plate surface of the folded and drawn formed portion 1 prior to ironing in a position that is sandwiched between the radius end 211*a* and the punch 20 upon completion of the ironing is thinned to the greatest extent by the shoulder portion 211. Therefore, from the viewpoint of suppressing the amount of generated coating residue, the amount of generation coating residue has a strong correlation with a ratio $r/t_{re}$ between the curvature radius r of the shoulder portion 211 and a thickness $t_{re}$ of the folded and drawn formed portion 1 at the position sandwiched between the radius end 211*a* and the punch 20 upon completion of the ironing.

Furthermore, the amount of generated coating residue also has a correlation with the ironing rate by the shoulder portion 211. The ironing rate is expressed by $\{(t_{re}\ c_{re})/t_{re}\}\times 100$, when the clearance between the radius end 211*a* and the punch 20 is represented by $c_{re}$, and the thickness of the folded and drawn formed portion 1 prior to ironing at the position sandwiched between the radius end 211*a* and the punch 20 upon completion of the ironing is represented by $t_{re}$. The clearance $c_{re}$ corresponds to the thickness of the folded and drawn formed portion 1 after ironing at the position sandwiched between the radius end 211*a* and the punch 20. As the ironing rate increases, the load applied to the surface of the Zn coated steel plate increases, leading to an increase in the amount of generated coating residue.

Figure 8:
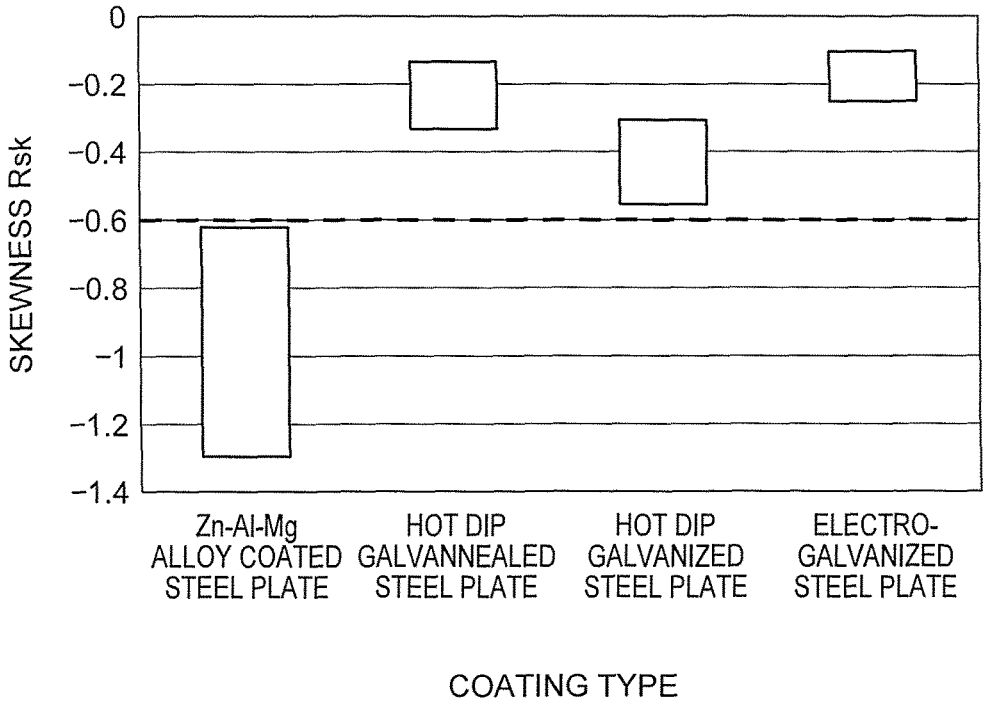
FIG. 8 is a graph showing a skewness Rsk of the coating layer in FIG. 7, for coating layers of various types.

Next, FIG. 8 is a graph showing the skewness Rsk of the coating layer 13 in FIG. 7, for coating layers of various types. The amount of generated coating residue also has a correlation with the skewness Rsk of the coating layer 13. The skewness Rsk is defined by Japanese Industrial Standard B0601 and is expressed by the following equation.

$$Rsk = \frac{l}{Rq^3}\left\{\frac{1}{l_r} - \int_0^{l_r} Z^3(x)dx\right\} \quad \text{[Math. 1]}$$

Here, Rq is root mean square roughness (=square root of a second moment of an amplitude distribution curve), and $\int Z^3(x)dx$ is a third moment of the amplitude distribution curve.

The skewness Rsk represents the probability of the existence of projecting portions in the irregularities 13*a* on the coating layer 13 (see FIG. 7). As the skewness Rsk becomes smaller, the number of projecting portions decreases and the amount of generated coating residue is suppressed. The skewness Rsk has been explained by the present applicant in Japanese Patent Application Publication No. 2006-193776.

As shown in FIG. 8, Zn—Al—Mg alloy coated steel plate, a hot dip galvannealed steel plate, hot dip galvanized steel plate and electro-galvanized steel plate may be cited as types of Zn coated steel plate. A typical Zn—Al—Mg alloy coated steel plate is formed by applying a coating layer constituted by an alloy containing Zn, 6% by weight of Al (aluminum), and 3% by weight of Mg (magnesium) to the surface of a steel plate. As shown in FIG. 8, the present applicant learned, after investigating the respective skewnesses Rsk of these materials, that the skewness Rsk of the Zn—Al—Mg alloy coated steel plate is included within a range of less than −0.6 and no less than −1.3, while the skewnesses Rsk of the other coated steel plates are included within a range of no less than −0.6 and no more than 0.

Figure 9:
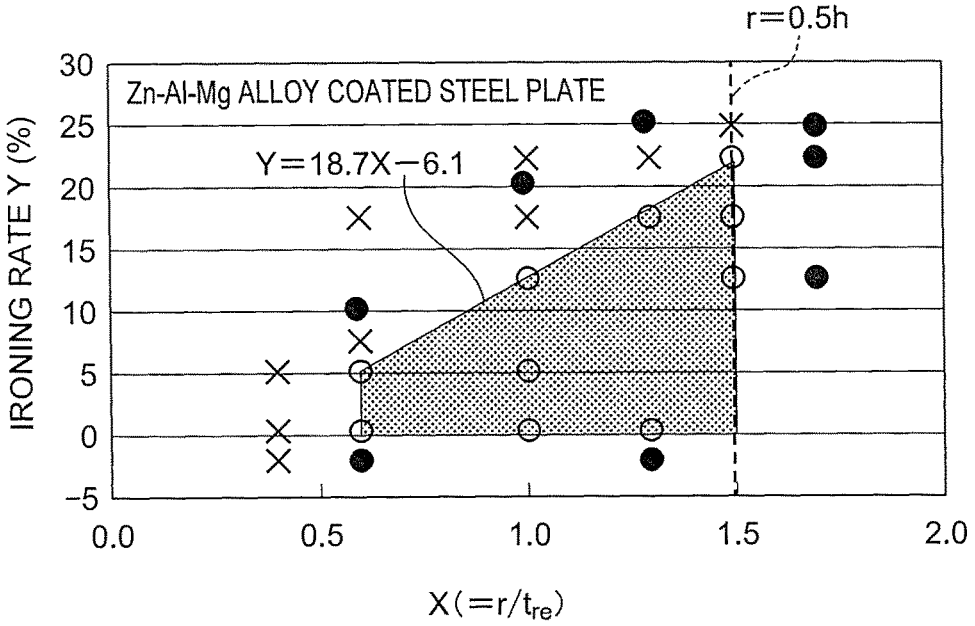
FIG. 9 is a graph showing a relationship between an ironing rate Y and X ($=r/t_{re}$) in relation to a Zn—Al—Mg alloy coated steel plate.

Next, FIG. 9 is a graph showing a relationship between an ironing rate Y and X ($=r/t_{re}$) in relation to the Zn—Al—Mg alloy coated steel plate. The present inventors performed ironing on a folded formed product obtained using the Zn—Al—Mg alloy coated steel plate as a raw material as shown in FIG. 2, under the conditions described below by using a mold of a structure shown in FIG. 5, while modifying the ironing rate and $r/t_{re}$. Note that the plate thickness of the sample was 1.8 mm, and a coating coverage was 90 $g/m^2$. Furthermore, the value of $t_{re}$ prior to ironing was 2.45 mm.

TABLE 1

| Chemical composition of sample (% by mass) | | | | | | | |
|---|---|---|---|---|---|---|---|
| Coating type | C | Si | Mn | P | S | Al | Ti |
| Zn—Al—Mg alloy coated steel plate | 0.002 | 0.006 | 0.14 | 0.014 | 0.006 | 0.032 | 0.056 |

TABLE 2

| Mechanical properties of sample | | | | |
|---|---|---|---|---|
| Coating type | Yield strength ($N/mm^2$) | Tensile strength ($N/mm^2$) | Elongation (%) | Hardness Hv |
| Zn—Al—Mg alloy coated steel plate | 164 | 304 | 49.2 | 87 |

TABLE 3

| Experiment conditions | |
|---|---|
| Pressing device | 2500 kN Transfer Press |
| Height of formed portion prior to ironing | 7.4 mm |
| Curvature radius of shoulder portion of forming mold | 2.0 mm |
| Curvature radius r of shoulder portion of ironing mold | 1.0 to 4.2 mm |
| Clearance of ironing mold | 1.84 to 2.50 mm |
| Press forming oil | TN-20 (manufactured by Tokyo Sekiyu Company Ltd.) |

The ordinate in FIG. 9 is the ironing rate, which is expressed by $\{(t_{re}-c_{re})/t_{re}\}\times100$, and the abscissa is the ratio between the curvature radius r of the shoulder portion 211 and the thickness $t_{re}$ of the folded and drawn formed portion 1 prior to the ironing at the position sandwiched between the radius end 211*a* and the punch 20 upon completion of the ironing, which is expressed by $r/t_{re}$. Circles show evaluations where it was possible to suppress coating residue generation and keep the inner diameter precision of the folded and drawn formed portion 1 within a predetermined range, black circles show results where the generation of coating residue was suppressed, but the inner diameter precision of the folded and drawn formed portion 1 deviated from the predetermined range, and crosses show evaluations where the generation of coating residue could not be suppressed.

As shown in FIG. 9, in the case of the Zn—Al—Mg alloy coated steel plate, or in other words, with a material in which the skewness Rsk is less than −0.6 and no less than −1.3, it was confirmed that the generation of coating residue can be suppressed, and good dimensional precision of the folded and drawn formed portion 1 can be maintained, in a region below a straight line denoted by $Y=18.7X-6.1$, where Y is the ironing rate and X is $r/t_{re}$, which is a region where $0.6\leq X\leq1.5$. When the radius r is such that $X>1.5$, then the internal diameter precision becomes worse. $X\leq1.5$ is the upper limit of r. As described above, the upper limit of the radius r has a correlation with the height h of the folded and drawn formed portion 1. When X=1.5, r=3.7 mm, and as shown in Table 3, since h=7.4 mm, then $X\leq1.5$ corresponds to $r\leq0.5$ h. In other words, with a material in which the skewness Rsk is less than −0.6 and no less than −1.3, it was confirmed that the generation of coating residue can be suppressed by determining the curvature radius r of the shoulder portion 211 and the clearance $c_{re}$ between the radius end 211*a* and the punch 20 so as to satisfy $Y\leq18.7X-6.1$, and $X\geq0.6$ and $r\leq0.5$ h. It should be noted that in the conditional expression above, $0<Y$ is defined so that ironing is not performed when the ironing rate Y is equal to or less than 0%.

Figure 10:
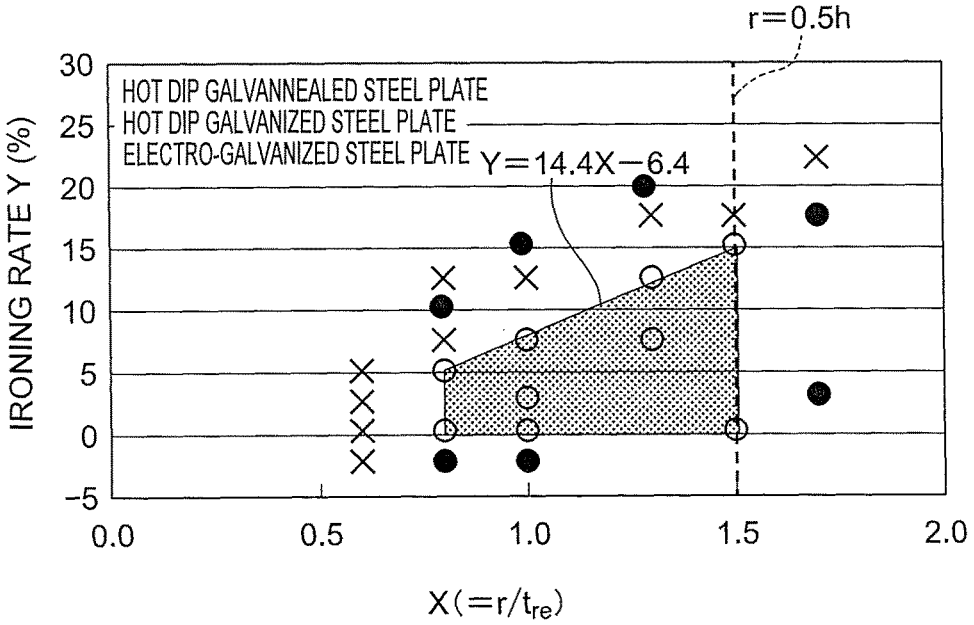
FIG. 10 is a graph showing the relationship between the ironing rate Y and X ($=r/t_{re}$) in relation to a hot dip galvannealed steel plate, a hot dip galvanized steel plate, and an electro-galvanized steel plate shown in FIG. 8.

Next, FIG. 10 is a graph showing the relationship between the ironing rate Y and X ($=r/t_{re}$) in relation to the hot dip galvannealed steel plate, the hot dip galvanized steel plate, and the electro-galvanized steel plate shown in FIG. 8. The present inventors performed a similar experiment under conditions described below in relation to the hot dip galvannealed steel plate, the hot dip galvanized steel plate, and the electro-galvanized steel plate. Note that experiment conditions such as the pressing device (see Table 3) were the same those of the ironing performed on the Zn—Al—Mg alloy coated steel plate described above. Furthermore, the hot dip galvannealed steel plate and the hot dip galvanized steel plate had a plate thickness of 1.8 mm and a coating coverage of 90 $g/m^2$. The electro-galvanized steel plate had a plate thickness of 1.8 mm and a coating coverage of 20 $g/m^2$. Furthermore, the value of $t_{re}$ prior to ironing was 2.45 mm.

TABLE 4

| Chemical composition of samples (% by mass) | | | | | | | |
|---|---|---|---|---|---|---|---|
| Coating type | C | Si | Mn | P | S | Al | Ti |
| Hot dip galvannealed steel plate | 0.003 | 0.005 | 0.14 | 0.014 | 0.006 | 0.035 | 0.070 |
| Hot dip galvanized steel plate | 0.004 | 0.006 | 0.15 | 0.014 | 0.007 | 0.039 | 0.065 |
| Electro-galvanized steel plate | 0.002 | 0.004 | 0.13 | 0.013 | 0.008 | 0.041 | 0.071 |

TABLE 5

| Mechanical properties of samples | | | | |
|---|---|---|---|---|
| Coating type | Yield strength ($N/mm^2$) | Tensile strength ($N/mm^2$) | Elongation (%) | Hardness Hv |
| Hot dip galvannealed steel plate | 175 | 315 | 46.2 | 89 |
| Hot dip galvanized steel plate | 178 | 318 | 45.7 | 90 |
| Electro-galvanized steel plate | 159 | 285 | 53.4 | 84 |

As shown in FIG. 10, in the case of the hot dip galvannealed steel plate, the hot dip galvanized steel plate, and the electro-galvanized steel plate, or in other words with materials in which the skewness Rsk is no less than −0.6 and no more than 0, it was confirmed that the generation of coating residue can be suppressed, and good dimensional precision of the folded and drawn formed portion 1 can be maintained, in a region below a straight line denoted by $Y=14.4X-6.4$, where Y is the ironing rate and X is $r/t_{re}$, which is a region where $0.8\leq X\leq1.5$. Similarly to the example in FIG. 9, when X=1.5, r=3.7 mm and as shown in Table 3, since h=7.4 mm, then $X\leq1.5$ corresponds to $r\leq0.5$ h. In other words, with a material in which the skewness Rsk is no less than −0.6 and no more than 0, it was confirmed that the generation of coating residue can be suppressed by determining the curvature radius r of the shoulder portion 211 and the clearance $c_{re}$ between the radius end 211*a* and the punch 20 so as to satisfy $Y\leq18.7X-6.1$, and $X\geq0.8$ and $r\leq0.5$ h.

In the ironing mold 2 and formed material manufacturing method of this kind, in the case of a material having a skewness Rsk of less than −0.6 and no less than −1.3, since the curvature radius r of the shoulder portion 211 and the clearance $c_{re}$ between the radius end 211*a* and the punch 20 are determined such that Y which is expressed by $\{(t_{re}-c_{re})/t_{re}\}\times100$ and X which is expressed by $r/t_{re}$ satisfy $0<Y\leq 18.7X-6.1$, and such that X satisfies $X\geq 0.6$, and r satisfies $r\leq 0.5$ h, then it is possible to avoid the generation of a large load on a part of the surface treated layer (coating layer 10), and the amount of generated powdery residue (coating residue) can be reduced. By reducing the amount of generated powdery residue, problems such as formation of minute pockmarks (dents) in the surface of the formed portion 1 after ironing, deterioration of the performance of a product manufactured using the formed material, and the need for an operation to remove the powdery residue, can be eliminated. This configuration is particularly effective when ironing is performed on a Zn coated steel plate.

Furthermore, in the case of a material having a skewness Rsk of no less than −0.6 and less than 0, since the curvature radius r of the shoulder portion 211 and the clearance $c_{re}$ between the radius end 211*a* and the punch 20 are determined such that Y which is expressed by $\{(t_{re}-c_{re})/t_{re}\}\times 100$ and X which is expressed by $r/t_{re}$ satisfy $0<Y\leq 14.4X-6.4$, and such that X satisfies $X\geq 0.8$, and r satisfies $r\leq 0.5$ h, then it is possible to reduce the amount of powdery residue generated by the ironing by the shoulder portion 211, similarly to the case of a material where the skewness Rsk is less than −0.6 and no less than −1.3.

In the embodiment, the surface treated metal plate is described as a Zn coated steel plate, but the present invention may be applied to other surface treated metal plates such as an aluminum plate having a painted film on the surface thereof, for example.

The invention claimed is:

1. An ironing mold for performing ironing on a folded and drawn formed portion which is formed using a surface treated metal plate as a raw material and which has an inner peripheral wall, an outer peripheral wall and a fold portion linking front ends of the inner peripheral wall and the outer peripheral wall, comprising:

a punch;

a die which is disposed on the outer periphery of the punch and which forms, with respect to the punch, a pushing hole into which the folded and drawn formed portion is pushed with the fold portion to the front; and a counter pad part which is disposed facing the punch and the die in such a manner that the folded and drawn formed portion is positioned between the punch and the die, and which pushes the folded and drawn formed portion into the pushing hole by relative displacement of the counter pad part with respect to the punch and the die, wherein the die includes a shoulder portion disposed on an outer edge of an inlet of the pushing hole and constituted by a curved surface having a predetermined curvature radius, and an inner peripheral surface which extends from a radius end of the shoulder portion in a pushing direction of the folded and drawn formed portion, and along which a surface of the outer peripheral wall of the folded and drawn formed portion slides in response to the pushing of the folded and drawn formed portion, a skewness Rsk of the surface treated metal plate is less than −0.6 and no less than −1.3, and the curvature radius of the shoulder portion and the clearance between the radius end and the punch are determined such that, when the curvature radius of the shoulder portion is represented by r, the clearance between the radius end and the punch is represented by $c_{re}$, a thickness of the folded and drawn formed portion prior to the ironing at a position that is sandwiched between the radius end and the punch upon completion of the ironing is represented by $t_{re}$ and a height of the folded and drawn formed portion is represented by h, then Y, which is expressed by $\{(t_{re}-c_{re})/t_{re}\}\times 100$, and X, which is expressed by $r/t_{re}$, satisfy $0<Y\leq 18.7X-6.1$, X satisfies $X\geq 0.6$, and r satisfies $r\leq 0.5$ h.

2. The ironing mold according claim 1, wherein the surface treated metal plate is a Zn coated steel plate formed by applying a Zn coating to a surface of a steel plate.

3. An ironing mold for performing ironing on a folded and drawn formed portion which is formed using a surface treated metal plate as a raw material and which has an inner peripheral wall, an outer peripheral wall and a fold portion linking front ends of the inner peripheral wall and the outer peripheral wall, comprising:

a punch;

a die which is disposed on the outer periphery of the punch and which forms, with respect to the punch, a pushing hole into which the folded and drawn formed portion is pushed with the fold portion to the front; and a counter pad part which is disposed facing the punch and the die in such a manner that the folded and drawn formed portion is positioned between the punch and the die, and which pushes the folded and drawn formed portion into the pushing hole by relative displacement of the counter pad part with respect to the punch and the die, wherein the die includes a shoulder portion disposed on an outer edge of an inlet of the pushing hole and constituted by a curved surface having a predetermined curvature radius, and an inner peripheral surface which extends from a radius end of the shoulder portion in a pushing direction of the folded and drawn formed portion, and along which a surface of the outer peripheral wall of the folded and drawn formed portion slides in response to the pushing of the folded and drawn formed portion, a skewness Rsk of the surface treated metal plate is no less than −0.6 and no more than 0, and the curvature radius of the shoulder portion and the clearance between the radius end and the punch are determined such that, when the curvature radius of the shoulder portion is represented by r, the clearance between the radius end and the punch is represented by $c_{re}$, a thickness of the folded and drawn formed portion prior to the ironing at a position that is sandwiched between the radius end and the punch upon completion of the ironing is represented by $t_{re}$ and a height of the folded and drawn formed portion is represented by h, then Y, which is expressed by $\{(t_{re}-c_{re})/t_{re}\}\times 100$, and X, which is expressed by $r/t_{re}$, satisfy $0<Y\leq 14.4X-6.4$, X satisfies $X\geq 0.8$, and r satisfies $r\leq 0.5$ h.

4. A formed material manufacturing method comprising the steps of:

forming a ring-shaped folded and drawn formed portion having an inner peripheral wall, an outer peripheral wall and a fold portion linking front ends of the inner peripheral wall and the outer peripheral wall, by performing at least one forming process on a surface treated metal plate; and performing ironing on the folded and drawn formed portion using an ironing mold after forming the folded and drawn formed portion, wherein the ironing mold includes:

a punch;

a die which is disposed on the outer periphery of the punch and which forms, with respect to the punch, a pushing hole into which the folded and drawn formed portion is pushed with the fold portion to the front; and a counter pad part which is disposed facing the punch and the die in such a manner that the folded and drawn formed portion is positioned between the punch and the die, and which pushes the folded and drawn formed portion into the pushing hole by relative displacement of the counter pad part with respect to the punch and the die, the die includes a shoulder portion disposed on an outer edge of an inlet of the pushing hole and constituted by a curved surface having a predetermined curvature radius, and an inner peripheral surface which extends from a radius end of the shoulder portion in a pushing direction of the folded and drawn formed portion, and along which a surface of the outer peripheral wall of the folded and drawn formed portion slides in response to the pushing of the folded and drawn formed portion, a skewness Rsk of the surface treated metal plate is less than −0.6 and no less than −1.3, and the curvature radius of the shoulder portion and the clearance between the radius end and the punch are determined such that, when the curvature radius of the shoulder portion is represented by r, the clearance between the radius end and the punch is represented by $c_{re}$, a thickness of the folded and drawn formed portion prior to the ironing at a position that is sandwiched between the radius end and the punch upon completion of the ironing is represented by $t_{re}$ and a height of the folded and drawn formed portion is represented by h, then Y, which is expressed by $\{(t_{re}-c_{re})/t_{re}\}\times 100$, and X, which is expressed by $r/t_{re}$, satisfy $0<Y\leq 18.7X-6.1$, X satisfies $X\geq 0.6$, and r satisfies $r\leq 0.5$ h.

5. The formed material manufacturing method according to claim 4, wherein the surface treated metal plate is a Zn coated steel plate formed by applying a Zn coating to a surface of a steel plate.

6. A formed material manufacturing method comprising the steps of:

forming a ring-shaped folded and drawn formed portion having an inner peripheral wall, an outer peripheral wall and a fold portion linking front ends of the inner peripheral wall and the outer peripheral wall, by performing at least one forming process on a surface treated metal plate; and performing ironing on the folded and drawn formed portion using an ironing mold after forming the folded and drawn formed portion, wherein the ironing mold includes:

a punch;

a die which is disposed on the outer periphery of the punch and which forms, with respect to the punch, a pushing hole into which the folded and drawn formed portion is pushed with the fold portion to the front; and a counter pad part which is disposed facing the punch and the die in such a manner that the folded and drawn formed portion is positioned between the punch and the die, and which pushes the folded and drawn formed portion into the pushing hole by relative displacement of the counter pad part with respect to the punch and the die, the die includes a shoulder portion disposed on an outer edge of an inlet of the pushing hole and constituted by a curved surface having a predetermined curvature radius, and an inner peripheral surface which extends from a radius end of the shoulder portion in a pushing direction of the folded and drawn formed portion, and along which a surface of the outer peripheral wall of the folded and drawn formed portion slides in response to the pushing of the folded and drawn formed portion, a skewness Rsk of the surface treated metal plate is no less than −0.6 and no more than 0, and the curvature radius of the shoulder portion and the clearance between the radius end and the punch are determined such that, when the curvature radius of the shoulder portion is represented by r, the clearance between the radius end and the punch is represented by $c_{re}$, a thickness of the folded and drawn formed portion prior to the ironing at a position that is sandwiched between the radius end and the punch upon completion of the ironing is represented by $t_{re}$ and a height of the folded and drawn formed portion is represented by h, then Y, which is expressed by $\{(t_{re}-c_{re})/t_{re}\}\times 100$, and X, which is expressed by $r/t_{re}$, satisfy $0<Y\leq 14.4X-6.4$, X satisfies $X\geq 0.8$, and r satisfies $r\leq 0.5$ h.

* * * * *